United States Patent [19]

Erfurth

[11] 4,325,308

[45] Apr. 20, 1982

[54] CONTROLLED-DISCHARGE DOOR FOR PARTICULATE MATERIALS AND LIQUIDS

[75] Inventor: Frank R. Erfurth, Boise, Id.

[73] Assignee: Morrison-Knudsen Co., Inc., Boise, Id.

[21] Appl. No.: 141,996

[22] Filed: Apr. 21, 1980

[51] Int. Cl.[3] ..... E01D 7/02; E01D 7/18

[52] U.S. Cl. ..... 105/280; 105/282 A

[58] Field of Search ..... 105/280, 281, 286, 288, 105/296, 297, 298

[56] References Cited

U.S. PATENT DOCUMENTS

| | | | |
|---|---|---|---|
| 1,312,465 | 8/1919 | Zaun | 105/281 |
| 1,627,256 | 5/1927 | Smith | 105/282 R |
| 3,596,608 | 8/1971 | Aquino | 105/296 |
| 3,650,221 | 3/1972 | Nagy | 105/258 |
| 3,831,803 | 8/1974 | Hutchison | 105/280 |

*Primary Examiner*—Richard A. Bertsch

*Attorney, Agent, or Firm*—Seed, Berry, Vernon & Baynham

[57] ABSTRACT

A controlled-discharge door assembly for particulate material or liquids includes a door member with a curved surface engaged by a large diameter roller mounted to a pivotable lever. The roller diameter is large in comparison to the length of the lever arm and provides variable torque multiplication as the roller moves along the curved surface of the door so that greater force is applied against the door when it is nearly closed. Resilient seals are provided around the door opening, the seal compressed by the discharge doors during closing to prevent leakage. The lever is moved over-center to hold the door in a locked position.

7 Claims, 10 Drawing Figures

FIG. 1
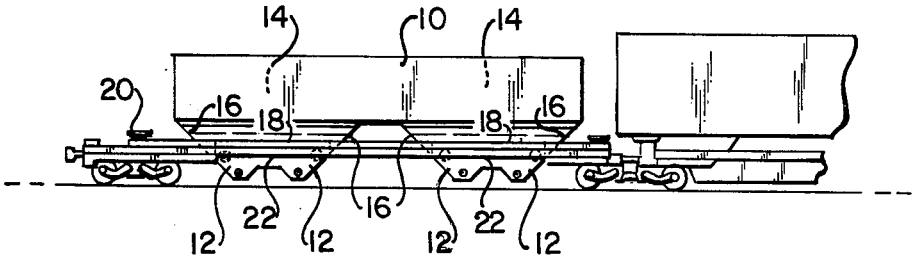
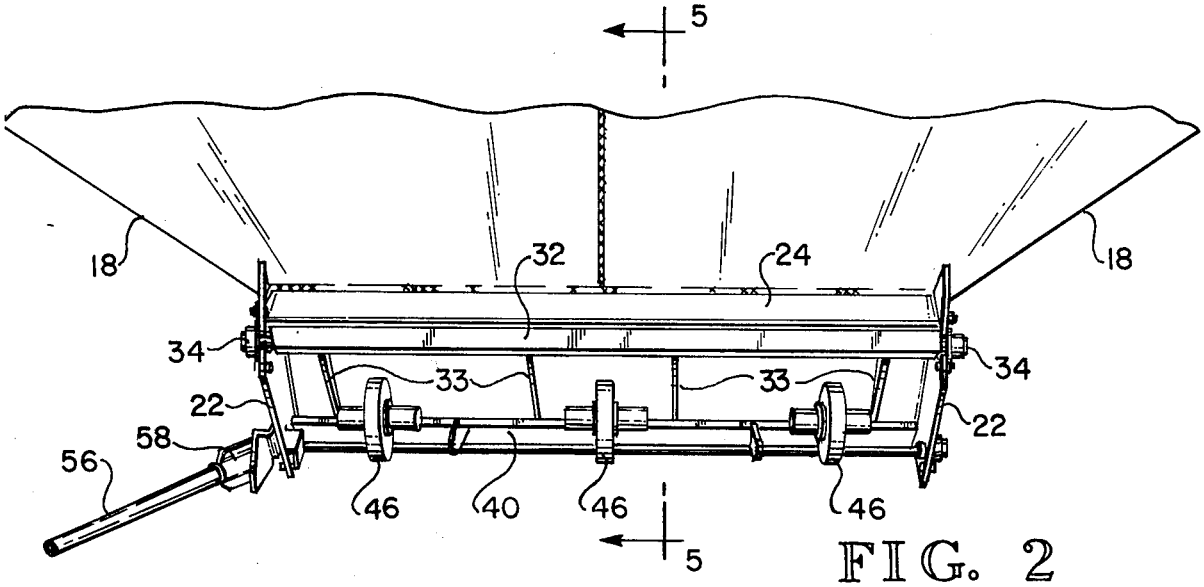
FIG. 2
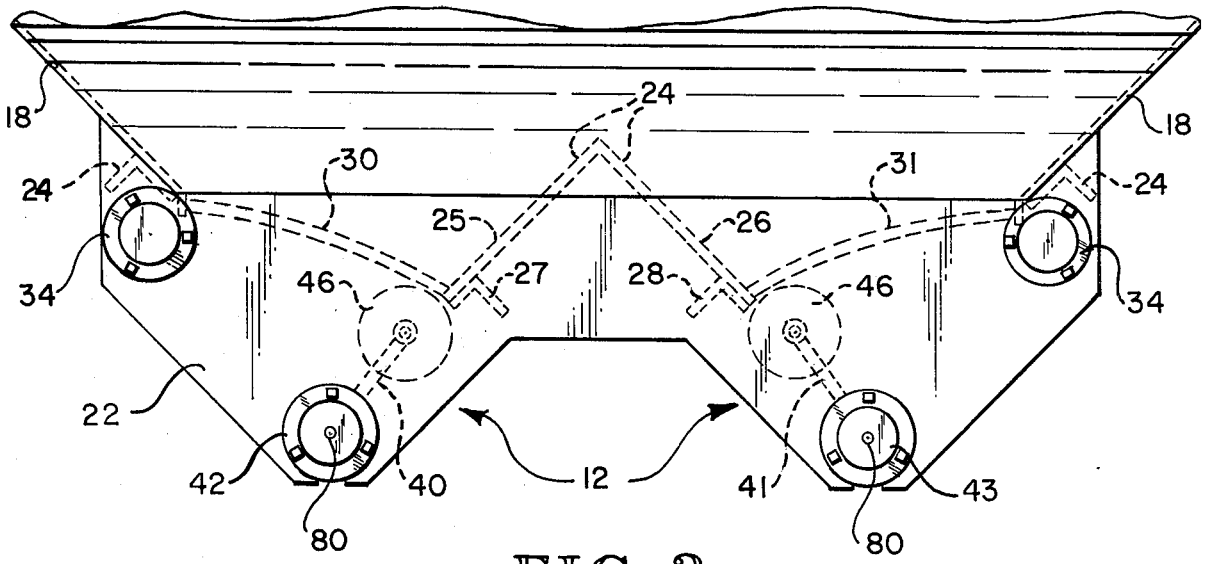
FIG. 3

CONTROLLED-DISCHARGE DOOR FOR PARTICULATE MATERIALS AND LIQUIDS

BACKGROUND OF THE INVENTION

1. Field of the Invention

This invention relates to doors for controlling the discharge flow of materials from a railway car hopper or the like.

2. Prior Art Related to the Disclosure

Heretofore, discharge doors for materials contained in railway hopper cars and the like have employed two types of doors for controlled release of the car contents. One type of discharge door currently in use is a slidable flat plate which is operated by a rack and pinion operating mechanism. Fine particles collect and are compacted along the top surface of discharge doors of this type. In addition, the weight of the material on the gate increases the frictional forces between the slidable plate and the plate guides which forces must be overcome by the rack and pinion operating mechanism.

A second type of discharge gate uses a hinged discharge door. A typical mechanism for operating a railway hopper car door is disclosed in U.S. Pat. No. 825,581, which shows a flat door tilted open by a plurality of pivotable crank arms to which are mounted pins which engage slots formed on a door assembly. U.S. Pat. No. 902,749 shows a rather complicated latch and operating mechanism for a railway car door which includes a small-diametered roller mounted at the end of a door-lifting arm, which roller engages a wearing shoe mounted to the underside of a flat door.

The various types of prior door and operating mechanisms, such as the two types mentioned above, are rather complicated in design and expensive to fabricate and maintain.

SUMMARY OF THE INVENTION

It is an object of the invention to provide a relatively simple design for a controlled-discharge door assembly which controls the discharge flow of particulate material or liquids contained in a railway car hopper or the like.

It is another object of the invention to provide a discharge door assembly having a resiliently sealed, self-locking door operating mechanism.

It is another object of the invention to provide a manually operated discharge door assembly which provides additional force when the door is nearly closed so that the door can be manually closed against the weight of the car contents and which provide a variable discharge opening for controlled release of the car contents.

It is another object of this invention to provide a discharge door assembly employing a cam-type lever system where the lever arm enables a person to open or close the door with a minimum of effort.

Another object of this invention is to provide a discharge door assembly employing a cam-type lever assembly employing relatively large diameter rollers which allow a shorter cam lever to obtain optimum torque multiplication for closing the door against the lading.

In accordance with these and other objects of the invention, a pivotable controlled-discharge door assembly is provided for controlled release of particulate material or liquids from a railway car hopper or the like. The door assembly includes door supports secured adjacent the discharge opening. The discharge door has a curved outer surface and is pivotally mounted to the door supports on one side. A lever is also pivotally mounted to the door supports beneath the discharge doors. The lever has at least one large-diametered roller mounted thereto which engages the curved surface of the door. The lever is positioned over-center to lock the door in a closed position. The diameter of the roller is large in comparison to the length of the lever arm so that the lever/roller combination provides force multiplication for manual operation of the door. One embodiment of the roller has a diameter approximately equal to the length of the lever so that greater force is available when the door is nearly closed, permitting the door to be closed against the weight of the contents of the hopper car and also permitting a variable discharge opening to be provided for controlled release of the car contents. Resilient seals are provided around the edges of the door opening.

BRIEF DESCRIPTION OF THE DRAWINGS

FIG. 1 is an elevation view of a railway hopper car having discharge door assemblies according to the invention;

FIG. 2 is a front elevation view of the lower portion of a railway car hopper showing a discharge door assembly;

FIG. 3 is a side elevation view of a dual discharge door assembly;

DETAILED DESCRIPTION OF THE PREFERRED EMBODIMENTS

Figure 4:
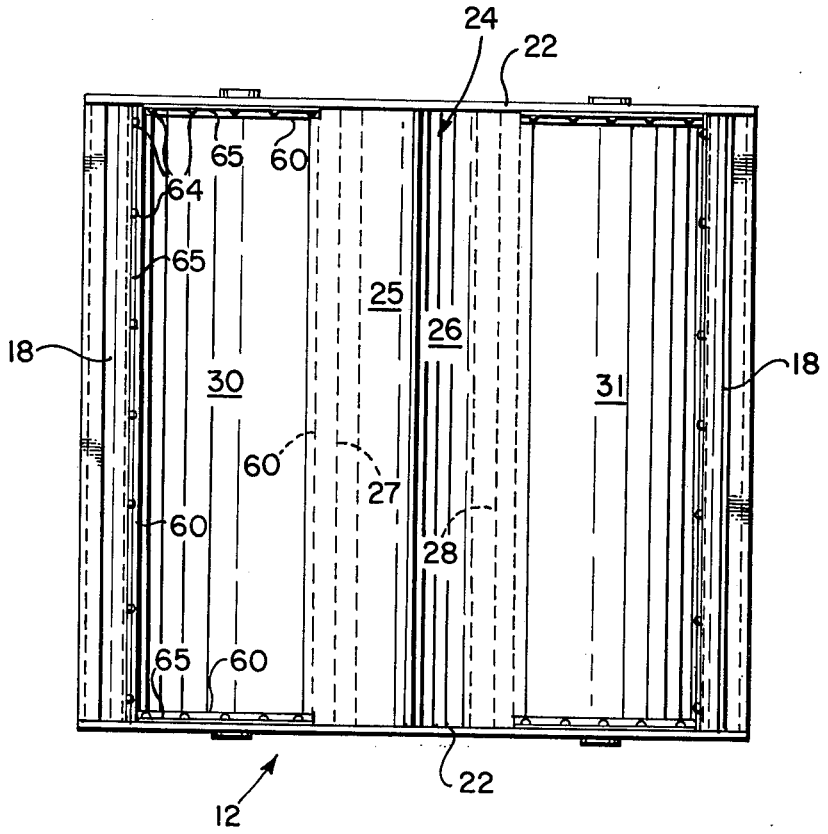
FIG. 4 is a plan view of a dual discharge door assembly.

Referring to FIG. 1, a typical railway hopper car 10 is shown for carrying particulate material, such as coal, grain, gravel, and the like and for carrying liquids, if desired. FIG. 2 shows one of a plurality of discharge door assemblies 12 which are typically mounted to cover the discharge openings of the hoppers for controlling discharge of the contents of the car. On the exemplary car 10 shown in FIG. 1, each end of the hopper has convergent chute portions 14 formed by inclined transverse lower walls 16 and inclined lower side walls 18. The hoppers are supported on the car chassis 20, the hopper side walls 18 and the transverse walls 16 forming rectangular-shaped discharge areas for emptying the contents of the car. A discharge door assembly 12 is mounted to cover the discharge openings on the lower end of each hopper so that it depends beneath the discharge area. FIG. 3 shows a side elevation view of a dual discharge door assembly, and FIG. 4 shows a plan view of the dual door assembly. Dual door assemblies are shown, although single door assemblies may be equally used.

Figure 5:
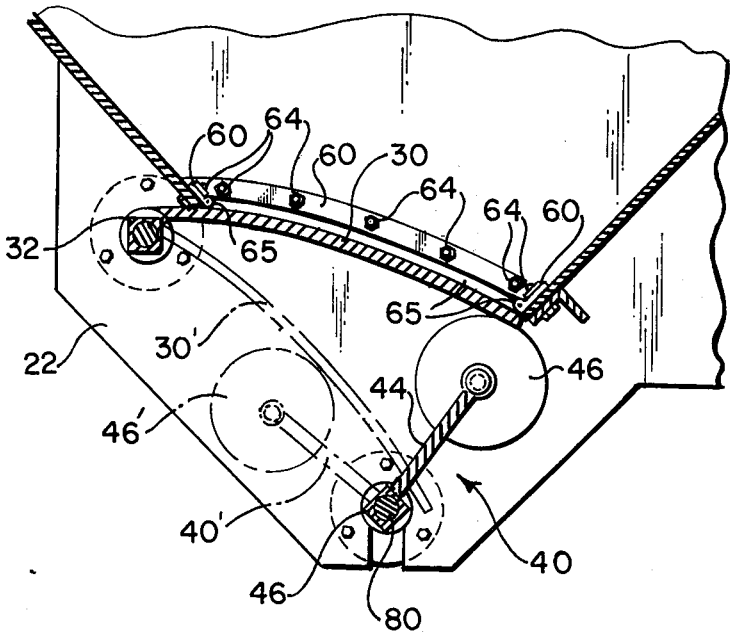
FIG. 5 is a detailed sectional view of a discharge door assembly taken along section line 4—4 of FIG. 2 showing, in phantom, a curved discharge door in an opened position.

The door support for each door assembly 12 includes a pair of parallely spaced, irregularly shaped side plates 22 which are each welded along their top margins to the bottom exterior of the hopper side walls 18 and transverse walls 16, as shown in FIG. 3. FIG. 2 shows one of a pair of transverse divider plates 24 which are welded to the interior faces of the side plates 22 and to the exterior faces of the hopper transverse wall 16, as shown in FIG. 3. The discharge opening of the hopper is divided by the transversely positioned divider plates 24 having sloping discharge surfaces 25 and 26 which are welded to the side walls 18 of the hopper to extend across the middle of the hopper discharge opening, as shown in FIG. 3. A pair of angle members 27, 28 provide support for the lower ends of the divider plates 24. A pair of doors 30, 31 are hinged at one end to the door supports and open downwardly to discharge the contents of the hopper. The doors 30, 31 are formed from curved rectangular plates and have curved lower surfaces reinforced by spaced-apart ribs 33. A square cross-sectioned bar 32 is welded to a long edge of each respective door 30, 31 and is rotatably journaled at each end to the oppositely spaced side plates 22 by bearing assemblies 34. The doors 30, 31 are thus hinged to the frame so that the free end of each door can swing between an open and a closed position, as indicated by FIG. 5.

A pair of lever arms 40, 41 are each pivotably mounted using bearing asemblies 42, 43 mounted on respective lowermost portions of the side plates 22, as shown in FIG. 3. As shown in more detail in FIG. 6, each lever includes a web plate portion 44 welded to a square cross-sectioned pivot bar member 46 which has its respective ends journalled in the bearings 42, 43.

Figure 6:
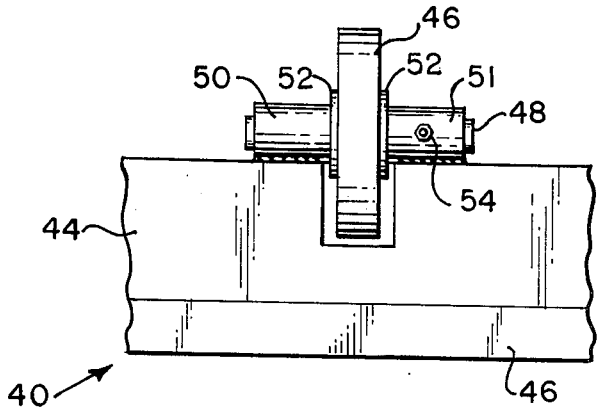
FIG. 6 is a detailed front elevation view of a roller and a portion of a lever.

A plurality of rollers 46 are mounted at spaced intervals along the length of the lever arms 40 and 41, as shown in FIGS. 2 and 6. Each roller 46 is rotatably mounted to the free end of the lever arms 40 and 41. Each roller is rotatably mounted on an axle shaft 48 extending through an axial bore in the roller. The axle shaft 48 is held in position by a pair of hollow cylindrical shaft-retaining collars 50, 51 which are welded to the free ends of the lever arms 40, 41, as shown in FIG. 6, so that the axis of rotation of the rollers is parallel to the free edge of the lever arms. A pair of washers 52 are positioned on either side of the roller 46. The shaft 48 is fixed in position by a nut threaded to a bolt 54 passing through one of the shaft-retaining collars 51. The diameter of each of the rollers is approximately equal to the length of the lever arms 40 and 41. As shown in FIG. 5, the rollers 46 engage the curved lower surface of the door 30. The levers 40, 41 are manually actuated by an operating bar 56 which has one end sitting within a socket member 58 fixed to one end of each of the levers 40, 41 (see FIG. 2).

Figure 9:
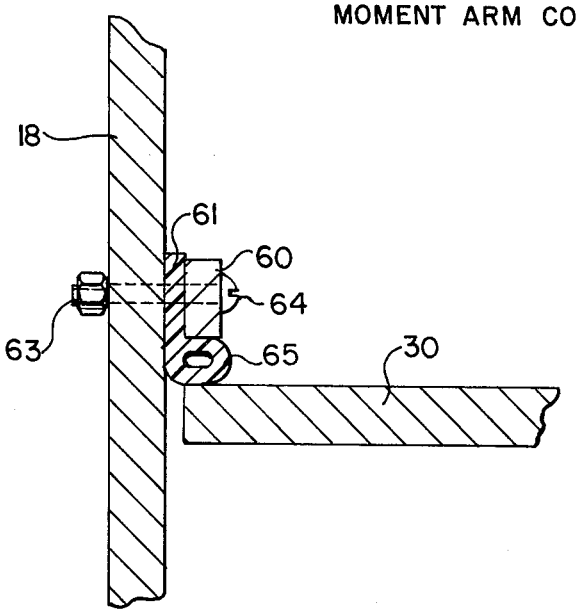
FIG. 9 is a cross-sectional view of one embodiment of a door seal.
Figure 10:
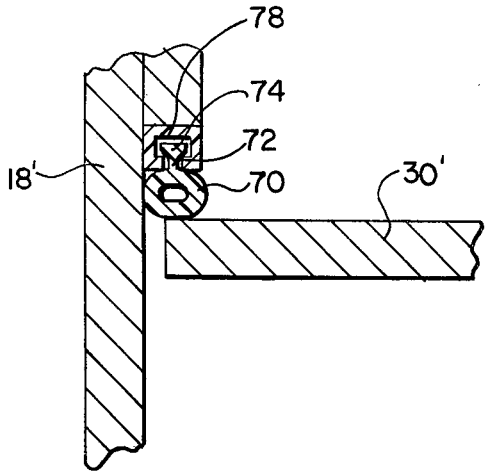
FIG. 10 is another embodiment of a door seal.

Each of the discharge openings is provided with resilient seal assemblies which are mounted around the margin of the discharge openings. FIGS. 9 and 10 show cross-sections of two embodiments of seal assemblies. For the arrangement of FIG. 9, mounting strips 60, as shown in FIG. 4, clamp a tangential flange 61 extending from a resilient hollow tubular seal member 65. The mounting strips are secured by nuts 63 and bolts 64. The hollow tubular seal member 62 is deformable, as shown in FIG. 9, to provide a seal between the top surface of the door 30 and the hopper walls.

An alternative means for resiliently sealing a door 30' to the hopper walls is illustrated in FIG. 10 and includes a deformable, hollow cylindrical seal member 70 having an integral, radially extending flange 72 which terminates in a T-section portion 74. The flange section 72 and the T-section 74 are mounted within a T-shaped key-slot formed in a mounting strip 78 which is secured to the walls of the hopper adjacent the opening. The seal member 70 engages the top surface of the door 30' to provide sealing.

Referring to FIG. 5, the door 30 is shown in a fully closed position with the lever 40 in an over-center position, locking the door 30 in place. The phantom representation of the lever 40' shows the door 30' in its fully opened position. The large diameter of the roller in comparison to the length of the lever arm 40 provides enhanced mechanical advantage or force multiplication for operating the door. The large diameter of the roller and the curved engaging surface of the door provide a variable force multiplication factor as the door is moved through its range of positions, such that greater torque is applied against the door 30 by lever 40 as the door is closed, thus permitting the door to be closed against the weight of the hopper contents. Using bar 58, the door may be positionable to provide variable discharge openings for controlled release of the contents of the hopper. The resilience of the seals around the discharge openings allows the lever to be moved over-center to the locked position while still permitting the door to be sealed.

Figure 7:
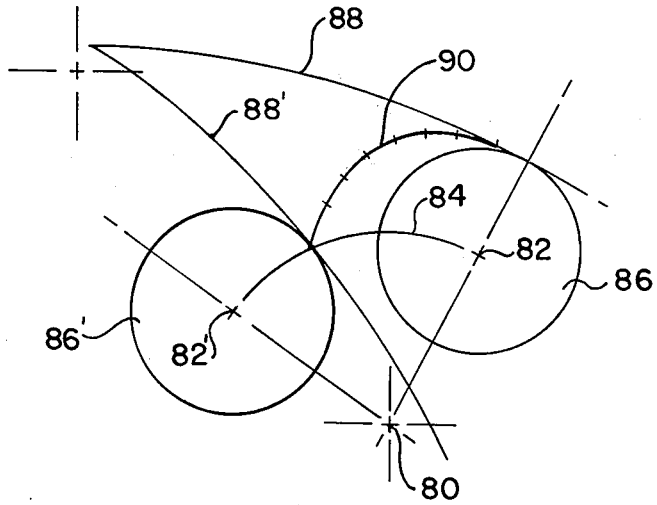
FIG. 7 is a diagram representing the locus of the point of contact between the roller and the curved door of the assembly according to the invention.
Figure 8:
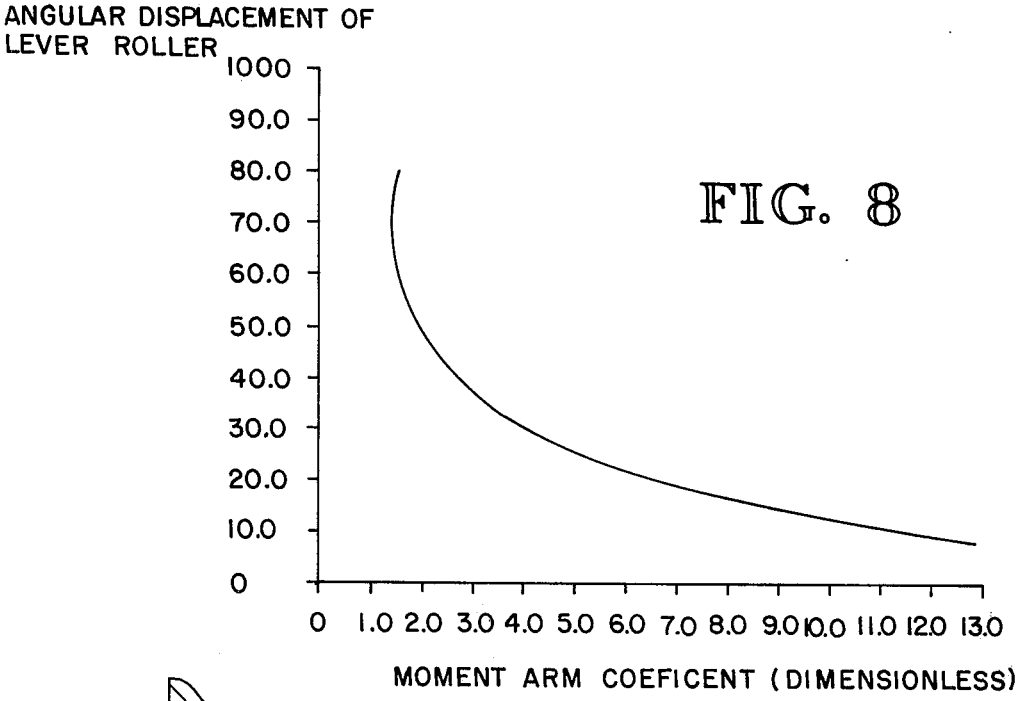
FIG. 8 is a graph representing a dimensionless moment coefficient which describes the variable moment arm ratio of the door assembly as a function of angular displacement of the lever/roller.

FIG. 7 is a graphical representation of moment coefficient as a function of angular displacement of the lever 40/roller 46 combination. Point 80 represents the axis of rotation of the lever arm 40. Points 82 and 82' represent the extreme positions (fully open and fully closed) of the axis of the roller 46 as its axis moves through an arc 84. The circles 86 and 86' represent the outer circumferences of the roller 46 located in its fully closed and open positions. The lines 88 and 88' represent the curved lower surface of the door 30, positioned in its fully opened and fully closed positions. The line 90 represents the locus of the points of intersection between the roller surface and the curved lower surface of the door 30. Points along the line 90 represent those contact points where the moment provided by the lever arm 40 is transferred to the door 30. The force multiplication or mechanical advantage provided by the lever arm 40 to operate the door 30 is equal to the ratio of the respective perpendicular distances between the line of action of the force transferred and the door pivot point and the lever arm pivot point. The ratio of these distances, or moment arms, is plotted as a dimensionless moment arm ratio for various angular displacements of the lever 40/roller 46 arrangement in FIG. 8. The displacement of the lever/roller is plotted with respect to a top dead-center position. Note that at top dead-center, the moment ratio would be extremely large and is, therefore, not plotted. The door is locked by placing the lever arm beyond top dead-center (not shown). The graph for displacement beyond top dead-center is the mirror-image of that plotted. The graph indicates that when the discharge door assembly is operated to place the door in a closed position, a large mechanical advantage is available to an operator so that the door can be closed against the weight of the contents of the hopper.

While particular embodiments of the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. A controlled-discharge door assembly for controlling the discharge of particulate or liquid contents of a hopper car or the like, comprising:

a discharge opening in the car;

door supports depending from the discharge opening;

a discharge door having a concave configured outer surface pivotally mounted at one end to the door supports for movement between a closed position wherein the door closes the discharge opening and an open position for discharge of the contents of the car therethrough;

a lever pivotally mounted at one end to the door supports beneath the pivotal connection of the discharge door and intermediate the ends of the discharge door; and a roller rotatably mounted to the lever and engaging the concave surface of the door intermediate its ends when the door is in its open position and movable along the curved surface of the door as the lever is moved about its pivotal connection, the roller having a diameter relative to the length of the lever arm such that a greater amount of force is applied against the door by the roller as the roller approaches the free end of the door opposite its pivotal connection to the door supports and as the door approaches its closed position, thereby permitting the door to be closed against the weight of the contents of the car being discharged through the discharge opening.

2. The discharge door assembly of claim 1 wherein the roller has a diameter approximately equal to the length of the lever to provide variable force multiplication as the door is moved through its range of opening so that greater force is applied against the curved door surface when the door is nearly to its closed position.

3. The discharge door assembly of claim 1, including means for manually operating the lever.

4. The discharge door assembly of claim 1, including resilient means around the discharge opening for sealing against the door in its closed position, said resilient means permitting the lever to travel over-center to the locked position.

5. The discharge door assembly of claim 1 wherein the lever includes a plate member pivotally mounted at one end to the door supports, with the axis of the roller mounted parallel to the plate member on the opposite end thereof, the plate member having a cutout portion providing clearance for the roller.

6. The controlled-discharge door assembly of claim 1 wherein the door is formed as a curved plate member.

7. A controlled-discharge door assembly for controlling the discharge of particulate or liquid contents of a hopper car or the like, comprising:

a discharge opening in the car;

door supports depending from the discharge opening;

a discharge door having a concave configured outer surface pivotally mounted at one end to the door supports for movement between a closed position wherein the door closes the discharge opening and an open position for discharge of the contents of the car therethrough;

a lever pivotally mounted at one end to the door supports beneath the pivotal connection of the discharge door and intermediate the ends of the discharge door; and a roller rotatably mounted to the lever having a diameter approximately equal to the length of the lever, the roller engaging the concave surface of the door intermediate its ends when the door is in its open position and movable along the curved surface of the door as the lever is moved about its pivotal connection to apply a greater amount of force against the door as the roller approaches the free end of the door opposite its pivotal connection to the door supports and as the door approaches the closed position, thereby permitting the door to be closed against the weight of the contents of the car being discharged through the discharge opening.

* * * * *